US006203165B1

(12) United States Patent
Chen

(10) Patent No.: US 6,203,165 B1
(45) Date of Patent: Mar. 20, 2001

(54) TOOL COMBINATION WITH AN ILUMINATION DEVICE

(76) Inventor: Martin Chen, P.O. Box 63-247, Taichung (TW)

( * ) Notice: Subject to any disclaimer, the term of this patent is extended or adjusted under 35 U.S.C. 154(b) by 0 days.

(21) Appl. No.: 09/425,349

(22) Filed: Oct. 22, 1999

(51) Int. Cl.[7] ..... B25B 23/18
(52) U.S. Cl. ..... 362/119; 362/120
(58) Field of Search ..... 362/109, 119, 362/120; 81/177.4, 177.6, 180.1, 490

(56) References Cited

U.S. PATENT DOCUMENTS 5,515,249 * 5/1996 Shiao ..... 362/119
5,678,919 * 10/1997 Huang ..... 362/109
5,873,648 * 2/1999 Shiao ..... 362/120
6,050,158 * 4/2000 Cassutti et al. ..... 81/490

FOREIGN PATENT DOCUMENTS

2189727 * 11/1987 (GB) ..... 81/490

* cited by examiner

*Primary Examiner*—Y. Quach
(74) *Attorney, Agent, or Firm*—Alan Kamrath Rider Bennett Egan & Arundel

(57) ABSTRACT

A tool combination includes a main body including a first compartment and a second compartment defined therein. A tool bit holder is formed on the main body. A tool bit carrier is removably mounted in the second compartment of the main body and carries at least one tool bit that is releasably held by the tool bit holder. A cap is releasably attached to the tool bit holder for enclosing the tool bit holder. An illumination device carrier is removably mounted in the first compartment and carries an illumination device for providing illumination.

6 Claims, 9 Drawing Sheets

TOOL COMBINATION WITH AN ILUMINATION DEVICE

BACKGROUND OF THE INVENTION

1. Field of the Invention

The present invention relates to a tool combination with an illumination device for providing illumination when required.

2. Description of the Related Art

Screwdrivers have existed for a long time. In some cases the user needs illumination when loosening or tightening screws, and it is inconvenient for the user to carry the screwdrivers and a flashlight or the like. The present invention is intended to provide a tool combination to solve this problem.

SUMMARY OF THE INVENTION

In accordance with a first aspect of the invention, a tool combination comprises:

a main body including a compartment defined therein;

a tool bit holder formed on the main body;

a tool bit carrier removably mounted in the compartment, the tool bit carrier carrying at least one tool bit that is releasably held by the tool bit holder; and a cap releasably attached to the tool bit holder for enclosing the tool bit holder.

In accordance with a second aspect of the invention, a tool combination comprises:

a main body including a compartment defined therein;

an illumination device carrier removably mounted in the compartment;

an illumination device carried by the illumination device carrier for providing illumination; and a switch for controlling on/off of the illumination device.

In accordance with a third aspect of the invention, a tool combination comprises:

a main body including a first compartment and a second compartment defined therein;

a tool bit holder formed on the main body;

a tool bit carrier removably mounted in the second compartment of the main body, the tool bit carrier carrying at least one tool bit that is releasably held by the tool bit holder;

a cap releasably attached to the tool bit holder for enclosing the tool bit holder;

an illumination device carrier removably mounted in the first compartment;

an illumination device carried by the illumination device carrier for providing illumination; and a switch for controlling on/off of the illumination device.

The tool combination in accordance with the present invention provides at least one compartment for receiving an illumination device carrier for providing illumination and/or for receiving a tool bit carrier that carries a plurality of different tool bits. The main body of the tool combination is constructed as a bottle and thus may be used as an ornament when not in functional use. The tool bits are stored for safety purpose. The illumination device may be used as a single unit in addition to direct illumination for the tool main body.

Other objects, advantages, and novel features of the invention will become more apparent from the following detailed description when taken in conjunction with the accompanying drawings.

BRIEF DESCRIPTION OF THE DRAWINGS

FIG. 7 is a sectional view similar to FIG. 6, wherein the switch is turned on;

DETAILED DESCRIPTION OF THE PREFERRED EMBODIMENT

Figure 1:
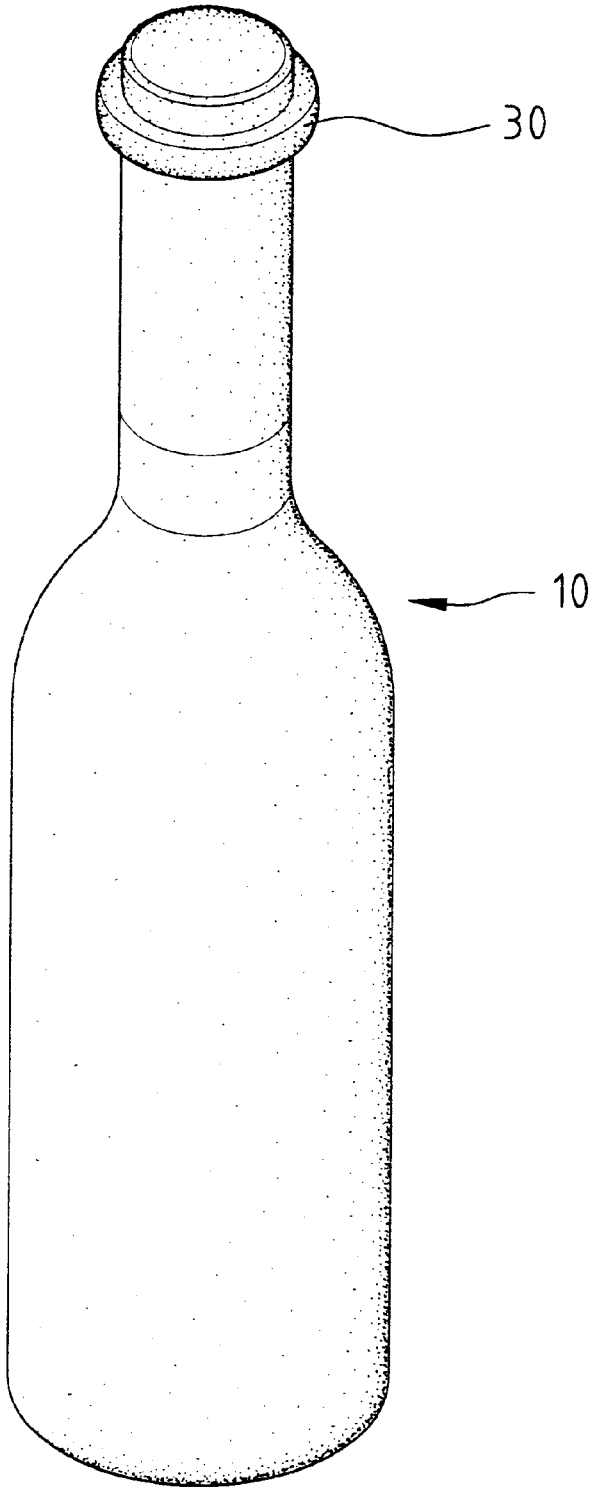
FIG. 1 is a perspective view of a tool combination in accordance with the present invention.
Figure 2:
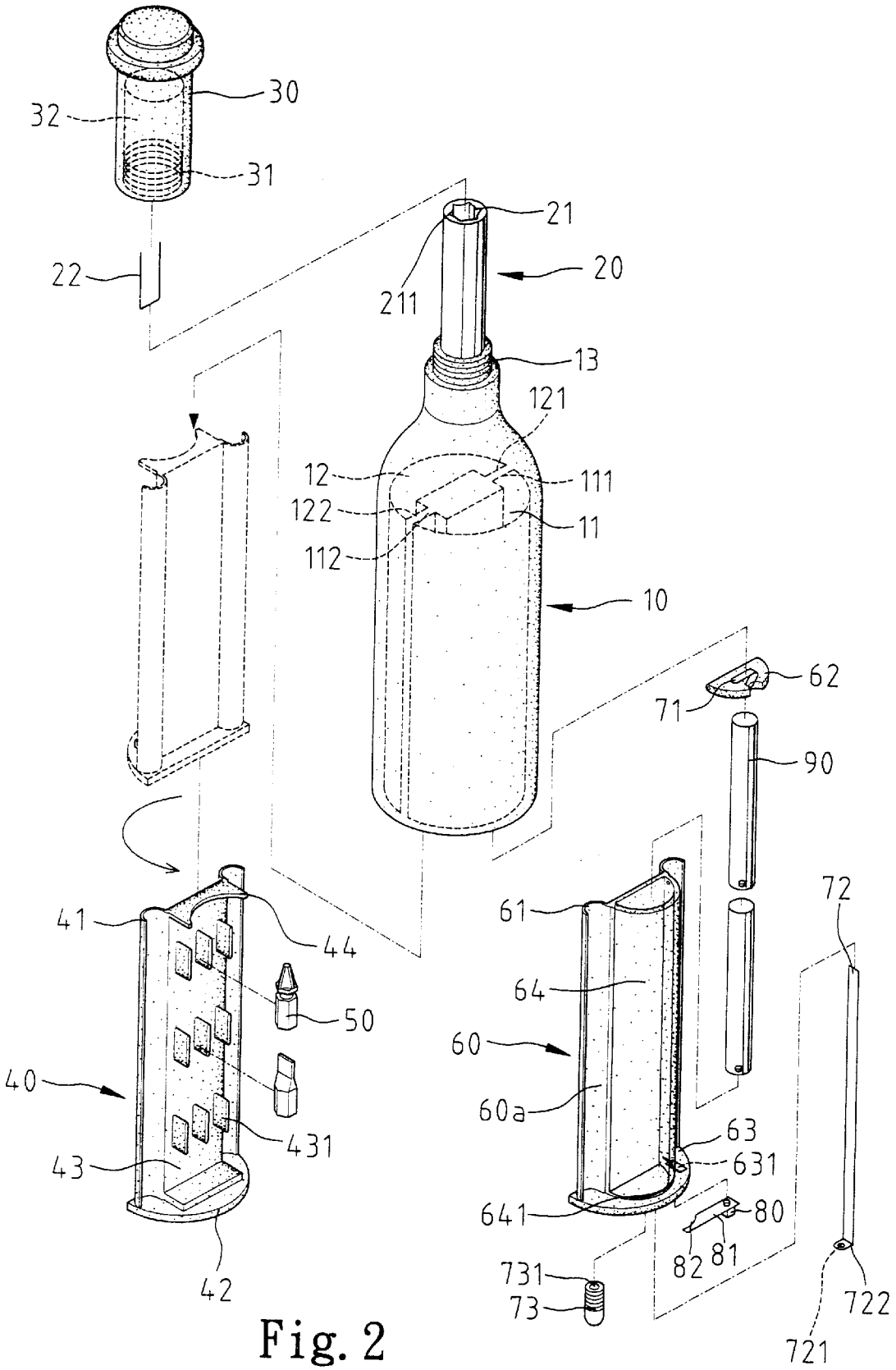
FIG. 2 is an exploded perspective view of the tool combination in accordance with the present invention.
Figure 3:
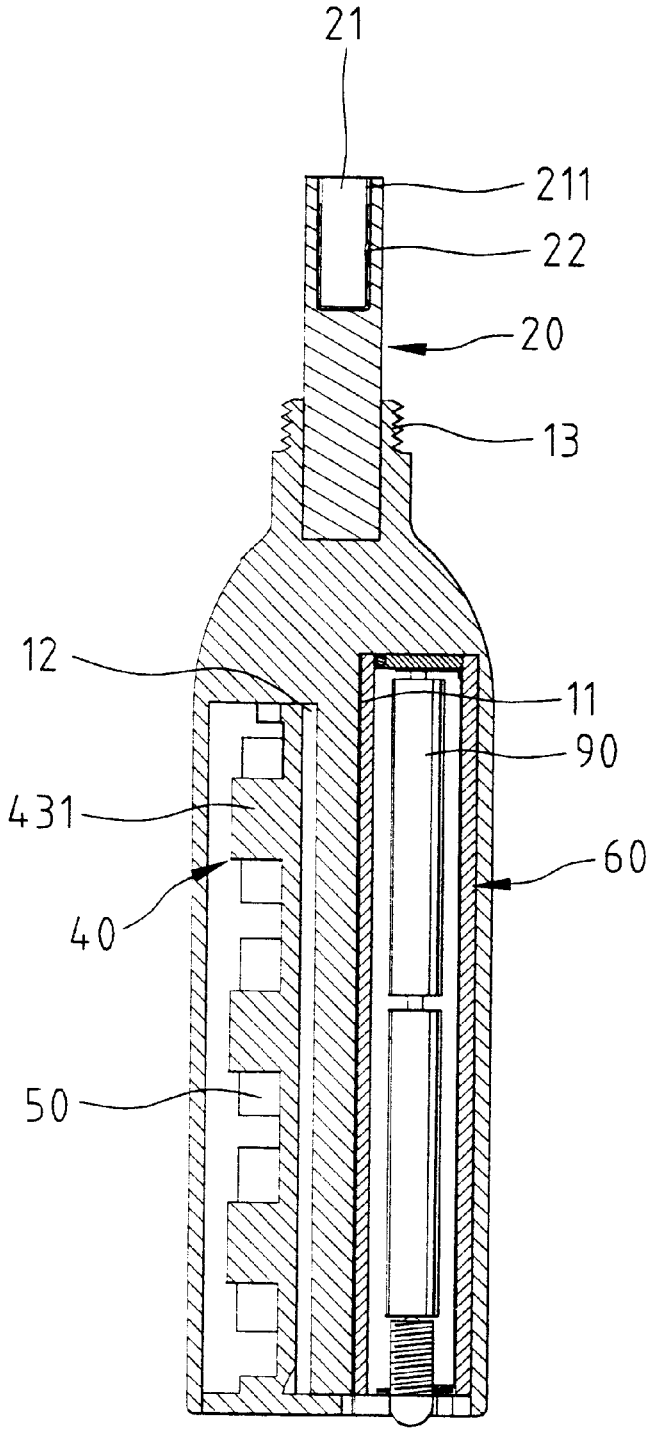
FIG. 3 is a sectional view of the tool combination in accordance with the present invention.

Referring to FIGS. 1 through 3, a tool combination in accordance with the present invention generally includes a main body 10 constructed as a bottle and having a first compartment 11 and a second compartment 12 defined therein. A wall defining the first compartment 11 includes two track grooves 111 and 112, and a wall defining the second compartment 12 includes two track grooves 121 and 122. A tool holder 20 is formed on an end of the main body 10 and includes a threaded section 13. The tool holder 20 includes a hexagonal holding groove 21 for holding a tool bit. A periphery defining the holding groove 21 includes two vertical channels 211 for receiving two limbs (not labeled) of a spring 22. The spring 22 may retain the tool bit in the holding groove 21. A cap 30 is releasably attached to the tool holder 20 and includes a receptacle 32 for accommodating the tool holder 20. The receptacle 32 of the cap 30 includes an inner threading 31 for engaging with the threaded section 13 of the tool holder 20.

A tool bit carrier 40 is removably mounted in the second compartment 12. In this embodiment, the tool bit carrier 40 includes two lateral sides 41 in the form of flanges so as to be slidable along the track grooves 121 and 122, respectively. The tool bit carrier 40 includes a stop 44 and a compartment 43 with a number of retaining plates 431 provided therein for retaining different tool bits 50 in place. The tool bit carrier 40 further includes a grasp portion 42 for easy grasp.

An illumination device carrier 60 is removably mounted in the first compartment 11. In this embodiment, the illumination device carrier 60 includes a main body 60*a* with two lateral sides 61 in the form of flanges so as to be slidable along the track grooves 111 and 112, respectively. The main body 60a further includes a battery compartment 64 for receiving batteries 90. A periphery defining the battery compartment 64 includes a slot 641 that is preferably defined along an arcuate configuration of the periphery. The main body 60*a* of the illumination device carrier 60 further includes a grasp portion 63 for easy grasp. The grasp portion 63 has a slot 631.

An illumination device 70 includes the batteries 90 received in the battery compartment 64, a first conductive plate 71, a second conductive plate 72, and a bulb 73 with a tip contact 731. The first conductive plate 71 is securely mounted to a lid of the illumination device carrier 60 for enclosing the battery compartment 64. The second conductive plate 72 is substantially L-shape and mounted in the battery compartment 64. The second conductive plate 72 includes an end 722 with a tip contact 721 for electrical contact with the bulb 73, and the tip contact 731 of the bulb 73 is in electrical contact with the batteries 90.

A switch 80 is slidably extended through the slot 631 of the grasp portion 63 for manual operation. The switch 80 includes a conductive plate 81 with an arcuate contact 82. The conductive plate 81 is slidably extended through the slot 641 of the main body 60*a* of the illumination device carrier 60.

Figure 4:
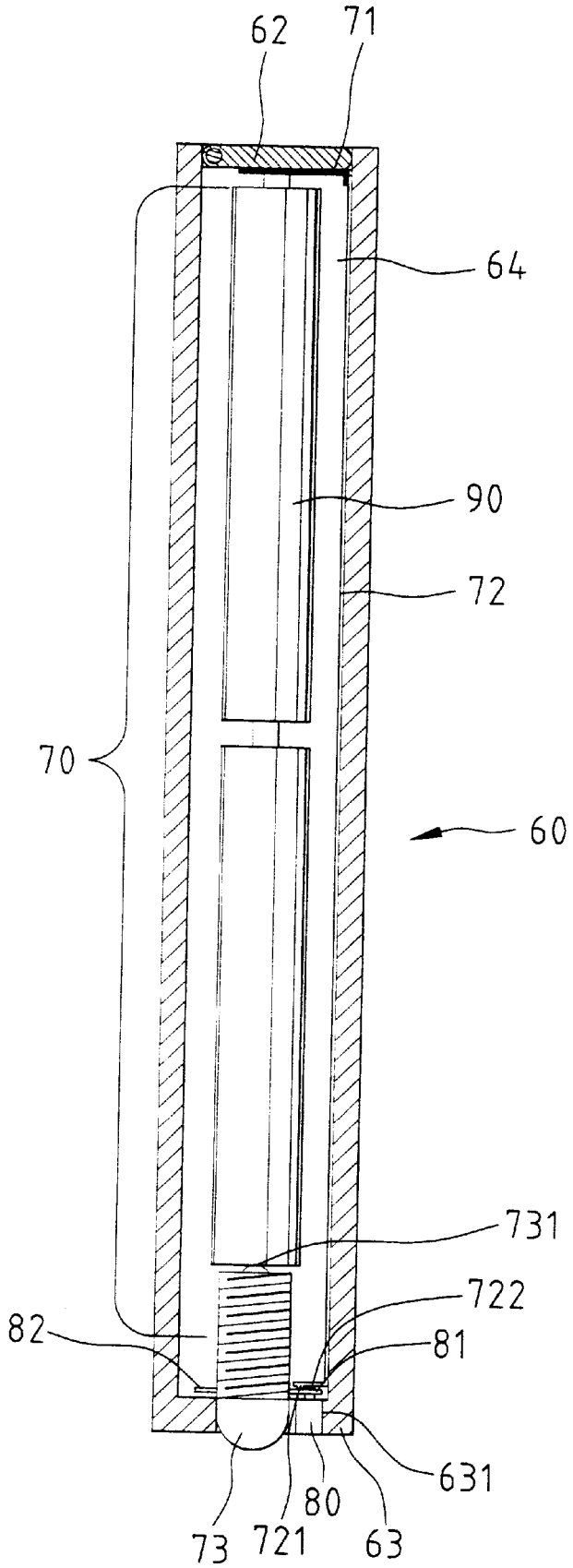
FIG. 4 is a sectional view, in an enlarged scale, of an illumination device of the tool combination in accordance with the present invention.
Figure 5:
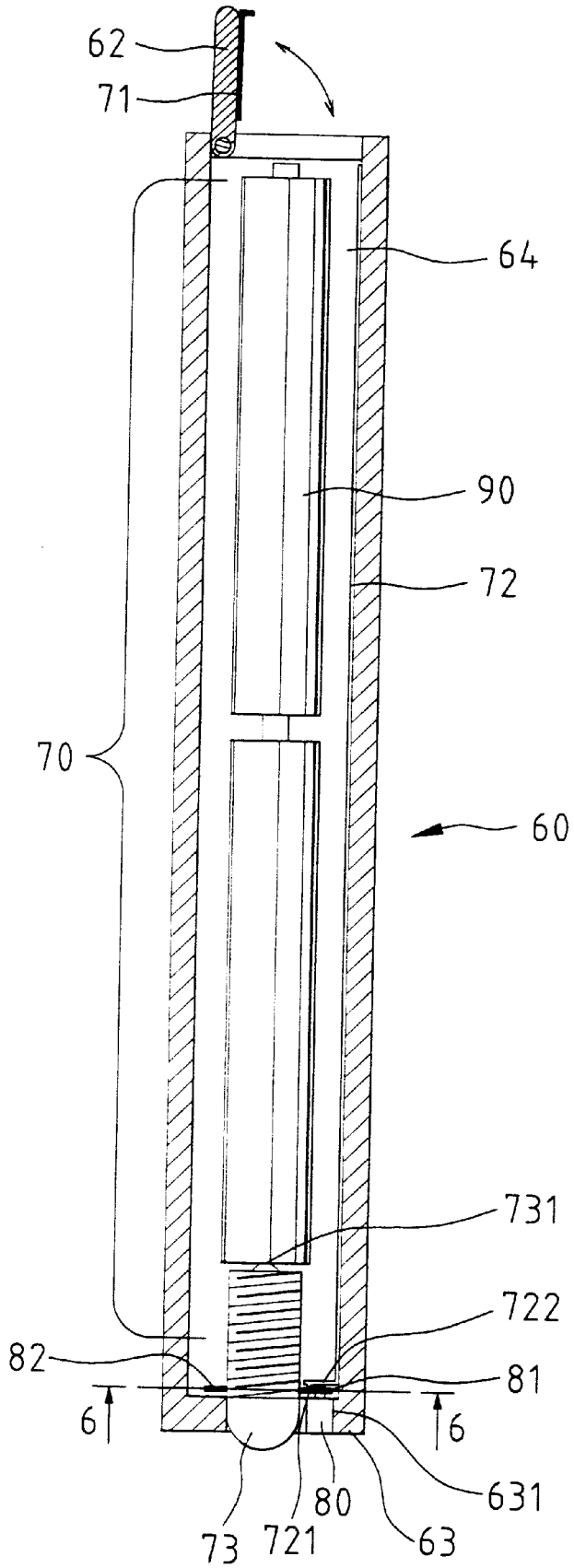
FIG. 5 is a sectional view similar to FIG. 4, wherein a lid of the illumination device is opened.
Figure 6:
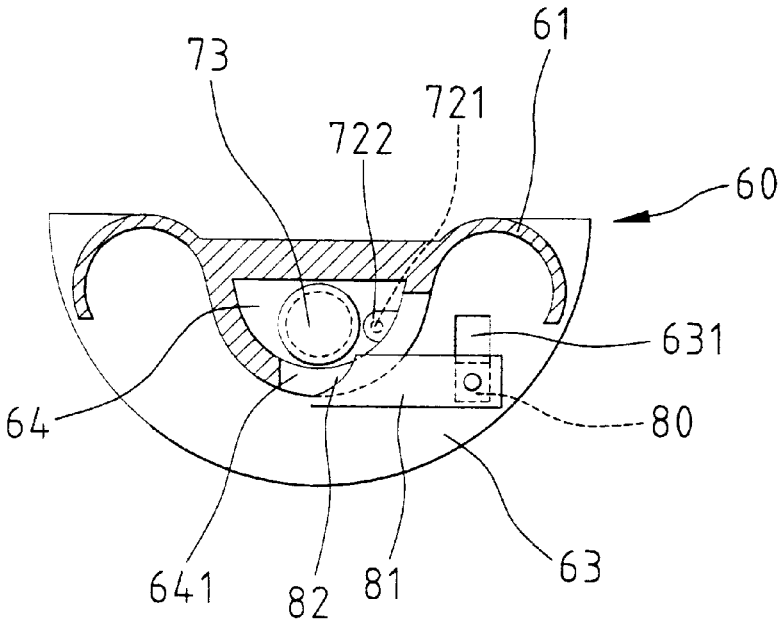
FIG. 6 is an enlarged sectional view taken along line 6—6 in FIG. 5, wherein the switch is turned off.
Figure 7:
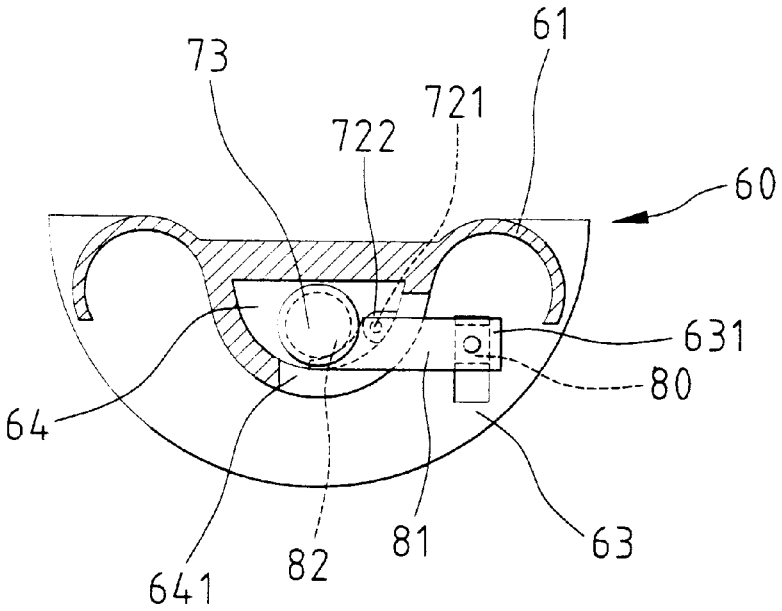

Referring to FIGS. 4 and 5, the lid 62 can be opened for insertion, removal, or replacement of batteries 90. Referring to FIG. 6, the switch 80 is in an off position, wherein the switch 80 is located in a front portion of the slot 631 such that the conductive plate 81 is not in electrical contact with the tip contact 721 of the second conductive plate 72. When the switch 80 is moved to a rear portion of the slot 631, the contact 82 of the conductive plate 81 is in electrical contact with the tip contact 721 of the second conductive plate 72, as shown in FIG. 7, thereby forming a closed circuit. Thus, the bulb 73 illuminates to provide required illumination.

Figure 8:
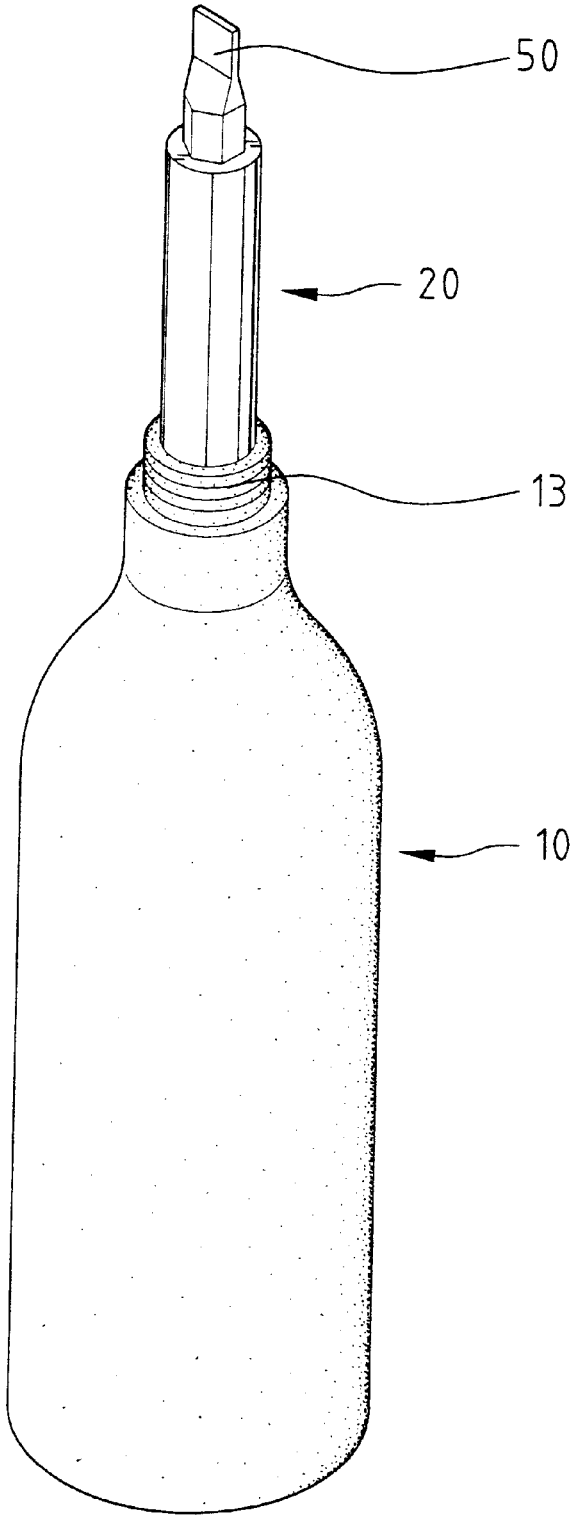
FIG. 8 is a perspective view of the tool combination, wherein a tool bit with a keystone tip is held in place for use.
Figure 9:
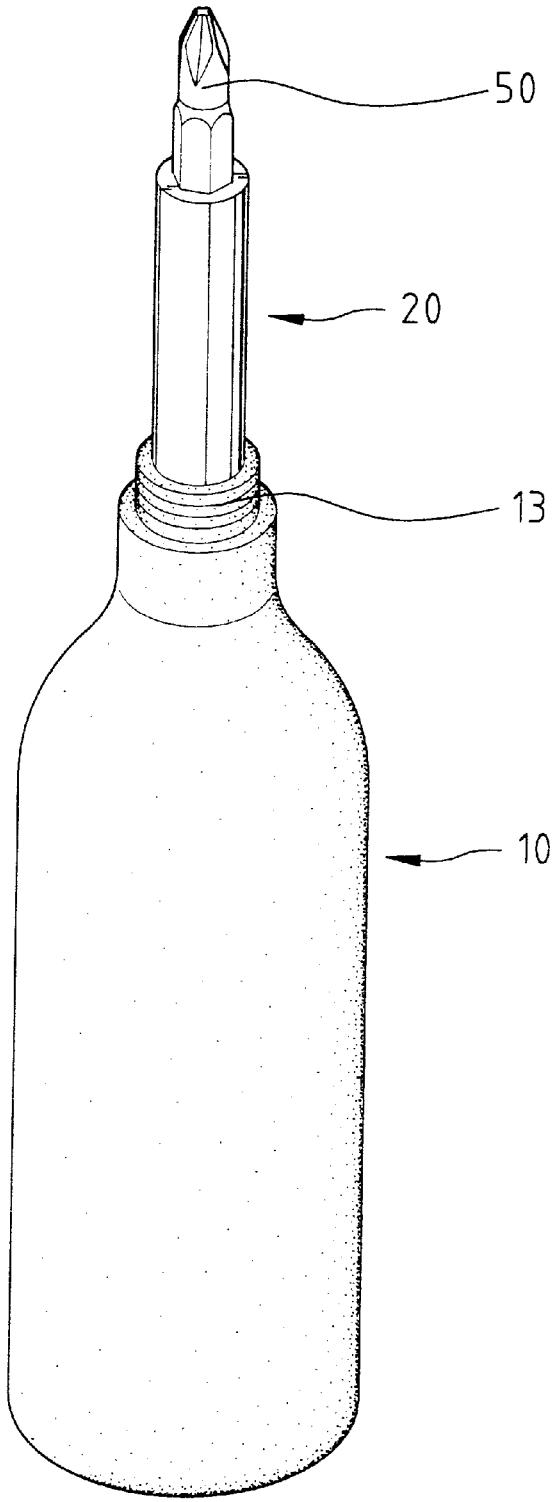
FIG. 9 is a perspective view of the tool combination, wherein a tool bit with a Phillips head tip is held in place for use.

Referring to FIGS. 2 and 8, the tool bit carrier 40 may be removed from the second compartment 12 of the main body 10, and the user may pick up a tool bit 50 with a keystone tip and insert it into the holding groove 21 of the tool bit holder 20. The tool bit 50 is retained in place by the spring 22. The user may put the tool bit carrier 40 back into the second compartment 12. Referring to FIG. 9, the user also may choose a tool bit 50 with a Phillips head tip when necessary.

Figure 10:
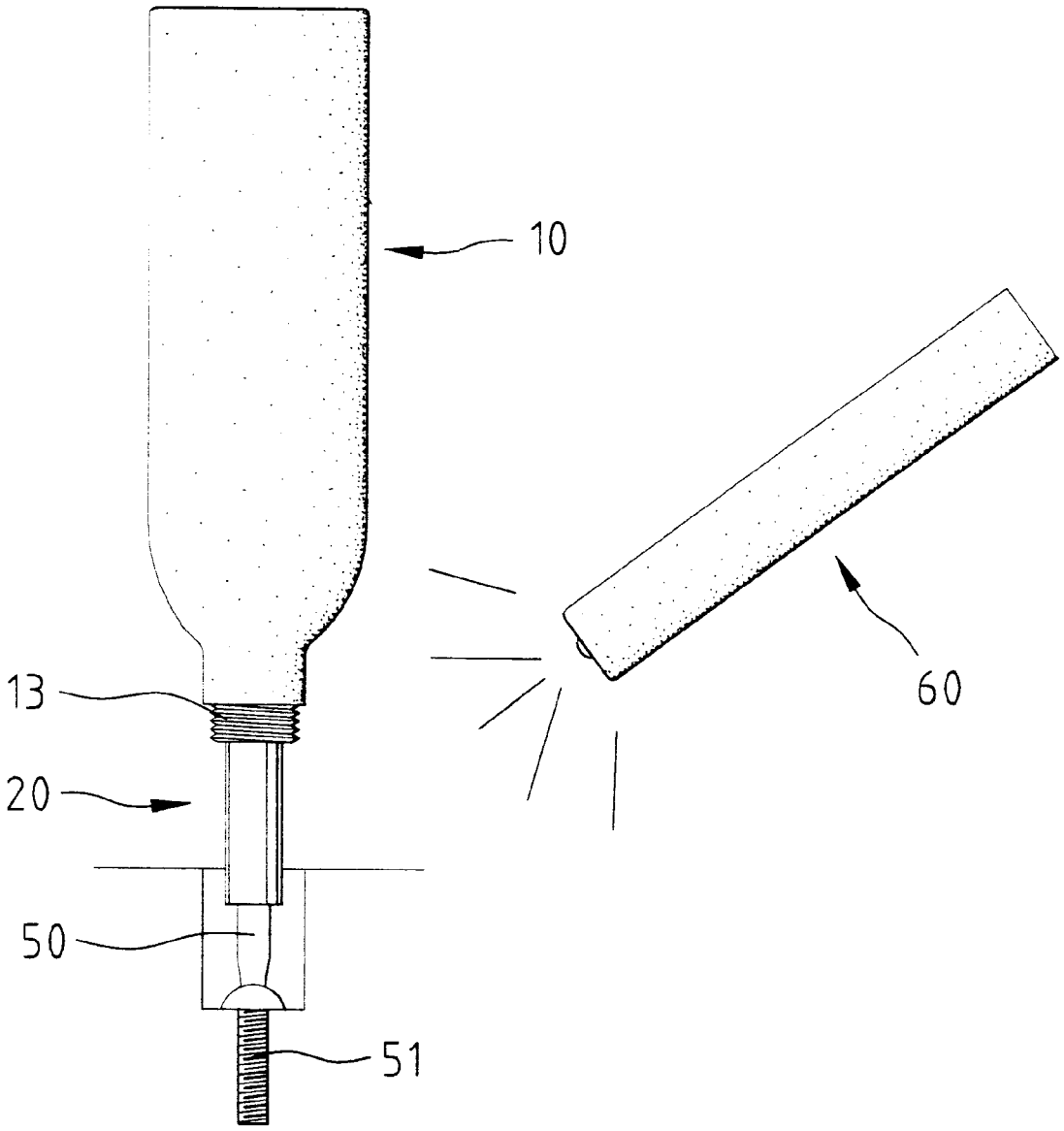
FIG. 10 is a schematic view illustrating use of the illumination device.

Referring to FIG. 10, the illumination device carrier 60 may be removed from the first compartment 11 to provide required illumination during loosening or tightening of a screw 51 by the tool bit 50.

According to the above description, it is appreciated that the tool combination in accordance with the present invention provides two compartments for receiving an illumination device carrier 60 for providing illumination and for receiving a tool bit carrier that carries a plurality of different tool bits. The tool bits may include hexagonal wrenches. Carriage of the tool bits and the bulb is easy and convenient. The main body of the tool combination is constructed as a bottle and thus may be used as an ornament when not in functional use. The tool bits are stored for safety purpose. The illumination device may be used as a single unit in addition to direct illumination for the tool main body.

Although the invention has been explained in relation to its preferred embodiment, it is to be understood that many other possible modifications and variations can be made without departing from the spirit and scope of the invention as hereinafter claimed.

What is claimed is:

1. A tool combination comprising:

a main body including a first compartment and a second compartment defined therein;

a tool bit holder formed on the main body;

a tool bit carrier removably mounted in the second compartment of the main body, the tool bit carrier carrying at least one tool bit that is releasably held by the tool bit holder;

an illumination device carrier removably mounted in the first compartment;

an illumination device carried by the illumination device carrier for providing illumination; and a switch for controlling on/off of the illumination device.

2. The tool combination as claimed in claim 1, wherein a wall defining the first compartment of the main body includes a track groove, and wherein the illumination device carrier includes a portion slidably guided by the track groove.

3. The tool combination as claimed in claim 1, wherein the illumination device carrier includes a grasp portion for easy grasp.

4. The tool combination as claimed in claim 1, wherein a wall defining the second compartment of the main body includes a track groove, and wherein the tool bit carrier includes a portion slidably guided by the track groove.

5. The tool combination as claimed in claim 1, wherein the tool bit carrier includes a grasp portion for easy grasp.

6. The tool combination as claimed in claim 5, further comprising a cap releasably attached to the tool bit holder for enclosing the tool bit holder.

* * * * *